US005283591A

United States Patent [19]

Delmas

[11] Patent Number: 5,283,591

[45] Date of Patent: Feb. 1, 1994

[54] FIXED-REFLECTOR ANTENNA FOR PLURAL TELECOMMUNICATION BEAMS

[75] Inventor: Jean-Jacques Delmas, Meudon, France

[73] Assignee: TeleDiffusion de France, Paris, France

[21] Appl. No.: 988,312

[22] Filed: Dec. 9, 1992

[30] Foreign Application Priority Data

Dec. 11, 1991 [FR] France ..... 91 15376

[51] Int. Cl.[5] ..... H01Q 19/10; H01Q 15/14

[52] U.S. Cl. ..... 343/755; 343/840; 343/757; 343/761; 343/914

[58] Field of Search ..... 343/755, 753, 754, 757, 343/761, 758, 840, 873, 912, 914, 839; H01Q 19/10, 15/14

[56] References Cited

U.S. PATENT DOCUMENTS

| | | | |
|---|---|---|---|
| 2,043,347 | 6/1936 | Clavier et al. | 343/755 |
| 3,189,907 | 6/1965 | Buskirk | 343/753 |
| 3,384,895 | 5/1968 | Webb | 343/873 |
| 4,837,583 | 6/1989 | Chevallier et al. | 343/761 |

FOREIGN PATENT DOCUMENTS

| | | |
|---|---|---|
| 3536348 | 4/1987 | Fed. Rep. of Germany . |
| 3801301 | 7/1989 | Fed. Rep. of Germany . |

*Primary Examiner*—Donald Hajec
*Assistant Examiner*—Hoan Ganh Le
*Attorney, Agent, or Firm*—Laubscher & Laubscher

[57] ABSTRACT

The antenna particularly for domestic, collective or community installations, receives plural telecommunication beams and comprises a preferably paraboloidal fixed reflector with an axis of symmetry. At least one grating of annular diffraction members is substantially symmetrical with regard to the axis and is placed parallel to the reflector. The grating defines first and second focal points symmetrical to the axis towards which are susceptible to converge first and second beams directed substantially parallel to straight lines going through the centre of the grating and through first and second focal points respectively. A microwave head can sweep the focal plane along a focal line, or several microwave heads are positioned on a gantry thereby receiving or emitting plural beams, though the reflector is fixed.

18 Claims, 6 Drawing Sheets

FIG. 7
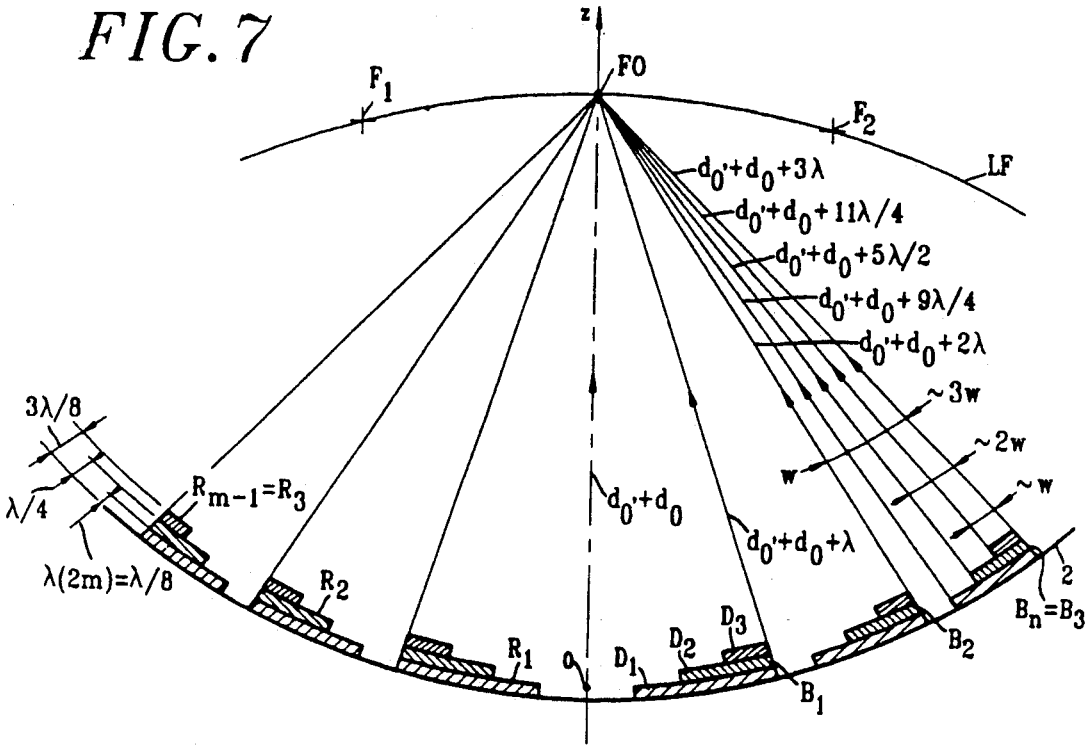
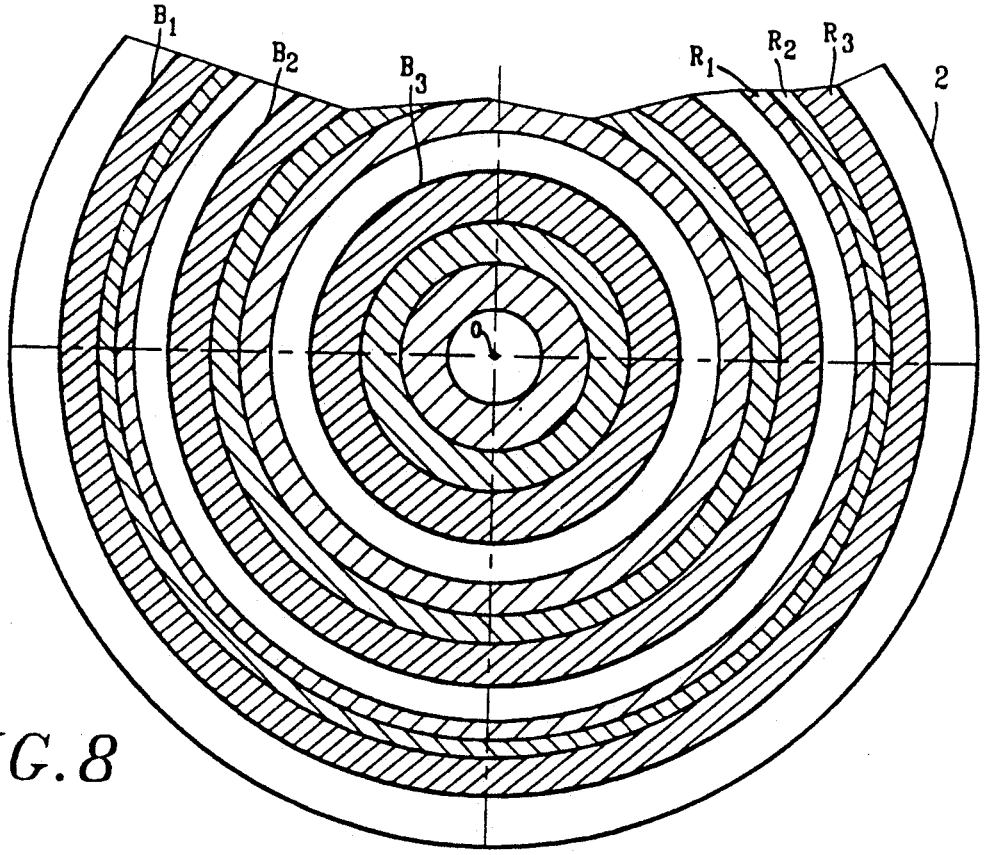
FIG. 8

FIXED-REFLECTOR ANTENNA FOR PLURAL TELECOMMUNICATION BEAMS

BACKGROUND OF THE INVENTION

1. Field of the Invention

The present invention relates to a telecommunication beam receiving or emitting antenna.

In particular, the antenna is intended for domestic installations in individual houses, for collective installations in buildings, or for community installations serving to feed the heads of cable networks for receiving plural beams emitted by telecommunication satellites, notably carrying television signals.

In addition, the invention can be used for professional applications notably in data communication networks.

2. Description of the Prior Art

The currently most widely sold antenna for satellite reception on the market comprises a fixed reflector of which the reflecting surface is a paraboloid of revolution, or an elliptical paraboloid, approximately 90 to 120 cm wide, or a portion of such a paraboloid for an antenna with off-axis illumination, referred to as an offset antenna. The axis of symmetry of the reflector is pointed towards the satellite whose transmissions are to be picked up. A microwave reception head, usually fastened by stays, is positioned at the single focus of the paraboloid reflector.

When the aforesaid satellite has an orbital position very close to other geostationary satellites, e.g. such as the TDF 1, OLYMPUS and TV SAT 2 satellites situated at 19° longitude west, the antenna can pick up the beams of these different satellites.

If the user wishes to receive beams from another satellite having an orbital position different to that of the abovementioned satellites, e.g. located at longitude east, the reflector of the receiving antenna must be turned around to be pointed to this other satellite. There are two solutions: either the user climbs onto the roof of a house or building in order to manually position the reflector, or the antenna must comprise remote-controlled motorized means for orientating the reflector.

In practice, the first solution is very rarely implemented by the user in view of the difficulty in gaining access to the antenna. It therefore requires recourse to an installation expert and a further adjusting of the position of the reflector, and is therefore highly dissuasive for the user.

The second solution is penalized by the cost of the antenna and its installation, an antenna with a motorized reflector requiring an infrastructure that is heavier and more cumbersome.

Other antennae are flat and are based on the FRESNEL lens principle (German patent applications Nos. 3,536,348 and 3,801,301) in order to remedy the high cost and unsightly appearance of parabolic antennae. However, these antennae also have a single focus and therefore a single pointing direction.

OBJECTS OF THE INVENTION

The main object of this invention is to remedy the disadvantages of the above-mentioned antennae.

Another object of this invention is to provide an antenna of which the reflector is stationary, i.e., is pointed for once and for all in a given direction, while enabling reception or emission of plural beams from or to satellites having different orbital positions included in a wide scanning angle.

SUMMARY OF THE INVENTION

Accordingly, there is provided an antenna for plural telecommunication beams, comprising a fixed reflector, a grating of annular diffraction members, or a portion of the grating, placed parallel to the reflector, and a microwave head facing the reflector. The reflector and the grating both have reflecting surfaces which are concave and issued from portions of surfaces that are substantially symmetrical in relation to an axis of symmetry. The diffraction grating defines first and second foci which are symmetrical about the axis of symmetry towards which are susceptible to converge first and second telecommunication beams directed substantially parallel to straight lines passing through the centre of the symmetrical surface and through the first and second foci respectively. The microwave head is positioned approximately along a substantially curved focal line which is centered on the axis of symmetry, has a radius of curvature at least substantially equal to the distance between the centre and each of the first and second foci, and passes through the first and second foci.

Due to the creation of two beam convergence foci by the diffraction grating, the antenna can pick up plural beams from satellites having completely different orbital positions. For instance, two microwave heads respectively placed at the two foci can simultaneously receive beams emitted by two telecommunication satellites having orbital positions several tens of degrees of longitude apart. The axis of symmetry of the reflecting surface of the reflector is then pointed for once and for all, not towards one of the satellites, but preferably towards the mid-perpendicular of the segment defined by the orbital positions of the two satellites.

When the antenna is of the off-axis illumination type, i.e., of the offset type, the reflector does not have an axial symmetry despite the fact that it issued from a portion of a surface that is symmetrical about an axis of symmetry In this case, the antenna only has a portion of the annular grating similar to that of the reflector, and cut out according to the contour of the reflector.

The diffraction grating is designed using the principle of diffraction of FRESNEL optical lenses, as will be seen hereinafter. The gain of the antenna embodying the invention is substantially equal to that of a conventional antenna with the same reflector. The rays of the beams are partly diffracted by the diffraction grating, and partly reflected by the annular portions of the reflecting surface of the reflector situated under the gaps between the members of the diffraction grating.

The diffraction grating can thus comprise a central cap-shaped member which is surrounded by annular members and is substantially symmetrical about said axis of symmetry, though a further embodiment of a diffraction grating embodying the invention could be solely comprised of annular members instead and in the place of the annular gaps between the members of the previous grating.

Theoretical calculations show that the dimensions of the diffraction grating depend on the wavelength corresponding substantially to the central frequency of a carrier frequency band of the satellite beams to be picked up, and that the distance between the reflecting surface of the reflector and the diffraction grating is substantially equal to one quarter-wavelength corresponding substantially to the central frequency of the carrier frequency band, particularly for a given diffraction gain according to a direction of a wavelength sufficiently short to enable utilisation of the antenna for reflection at a lower frequency. However, the measurements for antennae embodying the invention have shown that the dimensions of the diffraction grating authorize a relatively large tolerance.

Preferably, the widths of the grating members thus decrease radially from the axis of symmetry, and/or the widths of the gaps between the grating members decrease radially from the axis of symmetry The contours of at least one part of the grating members can then be substantially elliptical, the minor axes of the contours being located in a focal plane containing the first and second foci and the axis of symmetry. However, the contours of at least one part of the grating members can be circular and concentric, notably when the first and second foci are relatively close to the axis of symmetry of the reflector.

Preferably, the symmetrical surface from which the reflector is issued is a paraboloid, e.g. of revolution or elliptical, though the reflecting surface of the reflector may be of any other known concave shape having axial symmetry.

In order to demonstrate the feasibility of producing the antenna, particularly when the reflector is of a widely used type, such as a paraboloidal-type reflector, the diffraction identical to said antenna reflector, irrespective notably of whether the reflector is rotationally symmetrical and of the on-axis type, or of the off-axis feeding type.

In order to reduce the cost of producing the antenna, techniques can be used such as stamping, printing or metallic deposition on a machined or molded dielectric material, or techniques for implanting thin layers in a dielectric material.

In order to considerably increase antenna efficiency, an antenna embodying the invention comprises plural different gratings of annular diffraction members stacked parallel to one another in front of the reflector. The annular members of the gratings are then grouped into groups, at the rate of one member from each grating per group. The annular members in each group have outer edges stacked substantially perpendicular to the reflector and have inner edges forming steps from the reflector.

Such an antenna having plural diffraction gratings is all the more efficient when the following dimension rules are complied with:

the widths of the annular members in each of the groups decrease arithmetically from the reflector in a common difference substantially equal to the width of the group element of the group furthest away from the reflector;

the distance between the reflector and the immediately next one of the gratings and the distances between two neighbouring gratings are substantially equal to $\lambda/(2.m)$, where $\lambda$ is the wavelength corresponding substantially to a frequency preferably in a carrier frequency band of telecommunication beams and m-1 designates the number of the diffraction gratings.

The invention envisages various solutions for picking up satellite beams with a same fixed reflector fitted with one or more diffraction gratings.

According to a first embodiment, the antenna has plural microwave heads that are fixed along the focal line running through the two foci, after adjustment of their orientation. For instance, for a receiving antenna for satellite, plural first heads are fixed in the region of, i.e., within a few centimeters from, one of the foci for respectively picking up beams emitted from satellites having orbital positions with substantially equal longitudes; and/or plural second heads are fixed close to, i.e., within a few centimeters or tens of centimeters from, one of the foci for respectively picking up beams emitted from satellites having orbital longitude positions several degrees or tens of degrees apart.

The heads are positioned so as to pick up a maximum of radiations from the satellites respectively Accordingly, there is provided preferably motorized means for adjusting and locking the positions and orientations of the reception heads The adjusting and locking means enable various displacements of the heads, preferably substantially in the focal plane and along the focal line. In this way, the head adjusting and locking means can comprise means for individually translating the heads substantially in a direction parallel to the straight line running through the foci, and/or means for individually turning the heads about an axis perpendicular to the axis of symmetry and notably to the focal plane, and/or means for individually translating the heads in a direction substantially converging towards the centre of the reflector.

According to a second embodiment, the antenna only comprises one microwave head which is mobile and preferably multipolar in order to match to the various directions and polarizations of the telecommunication beams. Preferably motorized means are then attached to the reflector bearing structure for moving the head at least substantially along said focal line. The head moving means can comprise an arm extending across a central region of the antenna and having a first end supporting said head, and a second end mounted at least roatably around an axis substantially perpendicular to the focal plane.

BRIEF DESCRIPTION OF THE DRAWINGS

Further features and advantages of the invention will be apparent from the following particular description of several preferred embodiments of the antenna embodying the invention as illustrated in the corresponding accompanying drawings in which:

FIG. 7 is a schematic focal cross-section of a parabolic antenna having plural stacked diffraction gratings according to a second embodiment of the invention;

FIG. 8 is a partial top view of the antenna in FIG. 7; and

DESCRIPTION OF THE PREFERRED EMBODIMENTS

Figure 2:
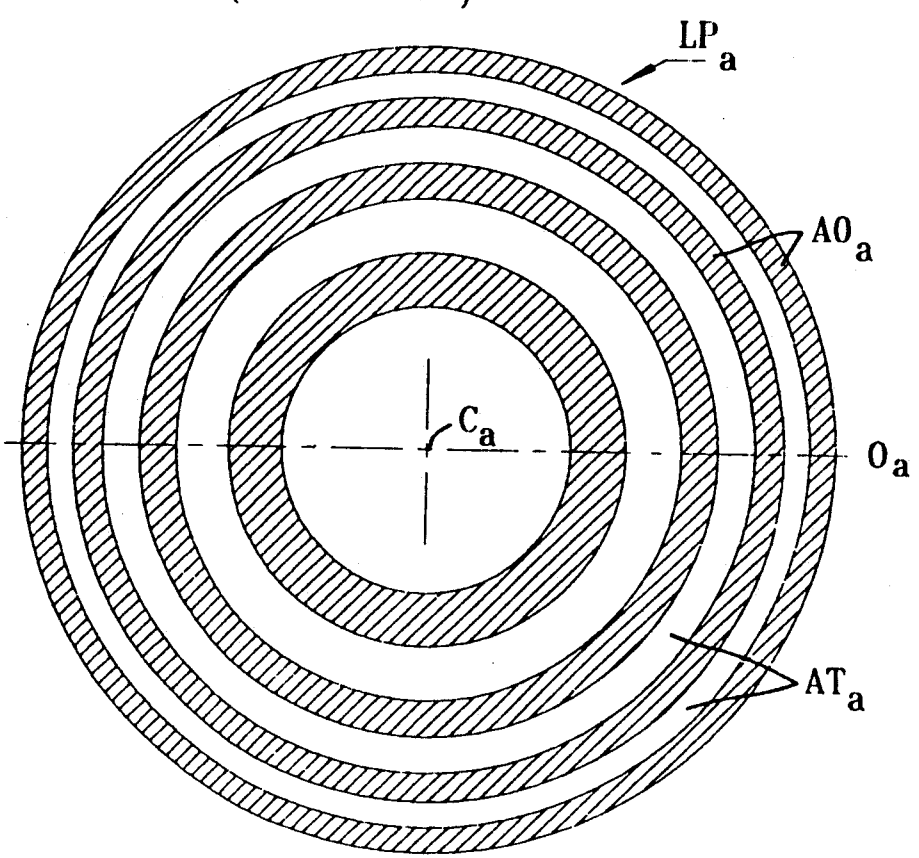
FIG. 2 (PRIOR ART)
FIGS. 1 and 2 are axial cross-section and front views of a flat FRESNEL lens with a circular diffraction grating, respectively.
Figure 1:
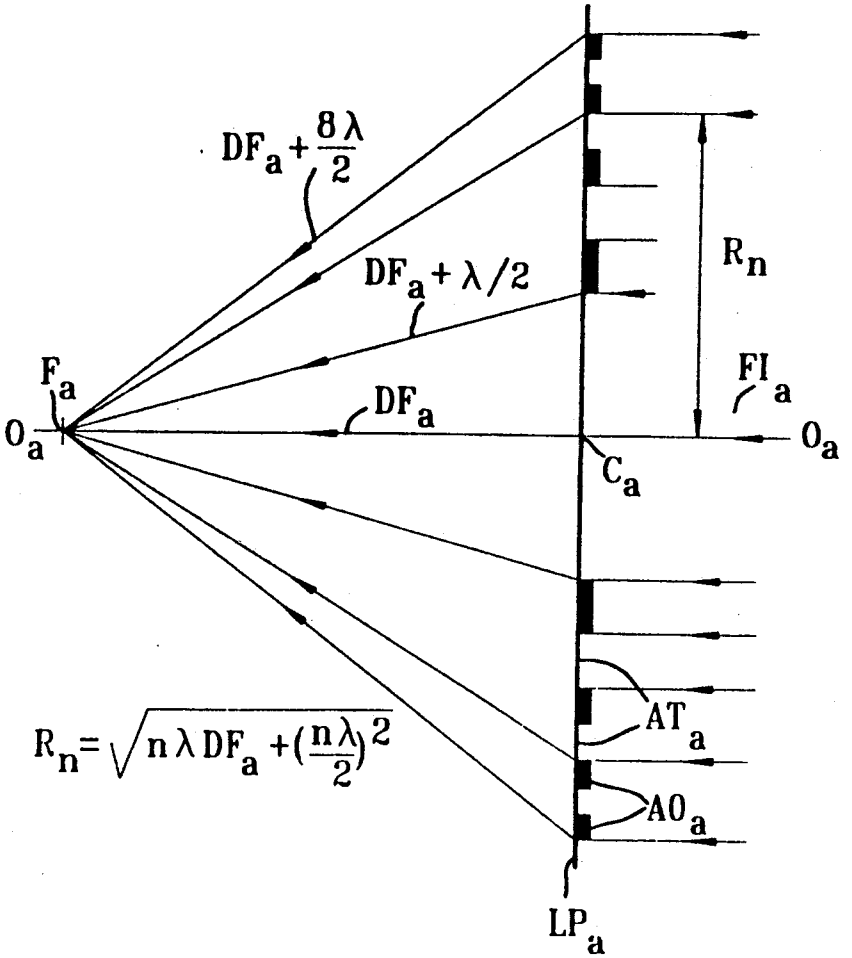
FIG. 1 (PRIOR ART)

There will ensue a description of the focussing characteristics of a flat lens with diffraction rings invented by the physician Charles FRESNEL. :

As shown in FIGS. 1 and 2, the flat lens $LP_a$ comprises plural concentric rings $AO_a$ made in an opaque material which are concentric to a common centre $C_a$. The opaque rings are affixed to a transparent film or plate and are thus alternated with transparent rings $AT_a$. For instance, the opaque rings are four in number.

An incident beam $FI_a$ collimated perpendicularly to the flat lens $LP_a$ is diffracted through the transparent rings $AT_a$. According to FRESNEL, the resultant diffracted beam is focussed on a focus $F_a$ situated along the principal axis $O_a$—$O_a$ of the lens $LP_a$ and at a focal length $DF_a$ from the centre $C_a$ of the lens when the path delay between two rays of the diffracted beam coming from the outer and inner edges of an opaque ring is equal to the half-wavelength $\lambda/2$ of the electromagnetic wave of the incident beam.

According to FIG. 2, the rays $R_n$ and $R_{n+1}$ of the inner and outer circular edges of the (n+1)/2nd opaque ring $AO_a$, where n is an integer increasing from 1, are:

$$R_n=[n.\lambda.DF_a+(n.\lambda/2)^2]^{\frac{1}{2}}$$

$$R_n=[(n+1).\lambda.DF_a+((n+1).\lambda/2)^2]^{178}$$

It appears, by calculating the difference $R_{n+1}-R_n$ as a function of the integer n, that the transparent rings $AT_a$ and opaque rings $AO_a$ have widths that decrease as they move away from the centre $C_a$.

Figure 4:
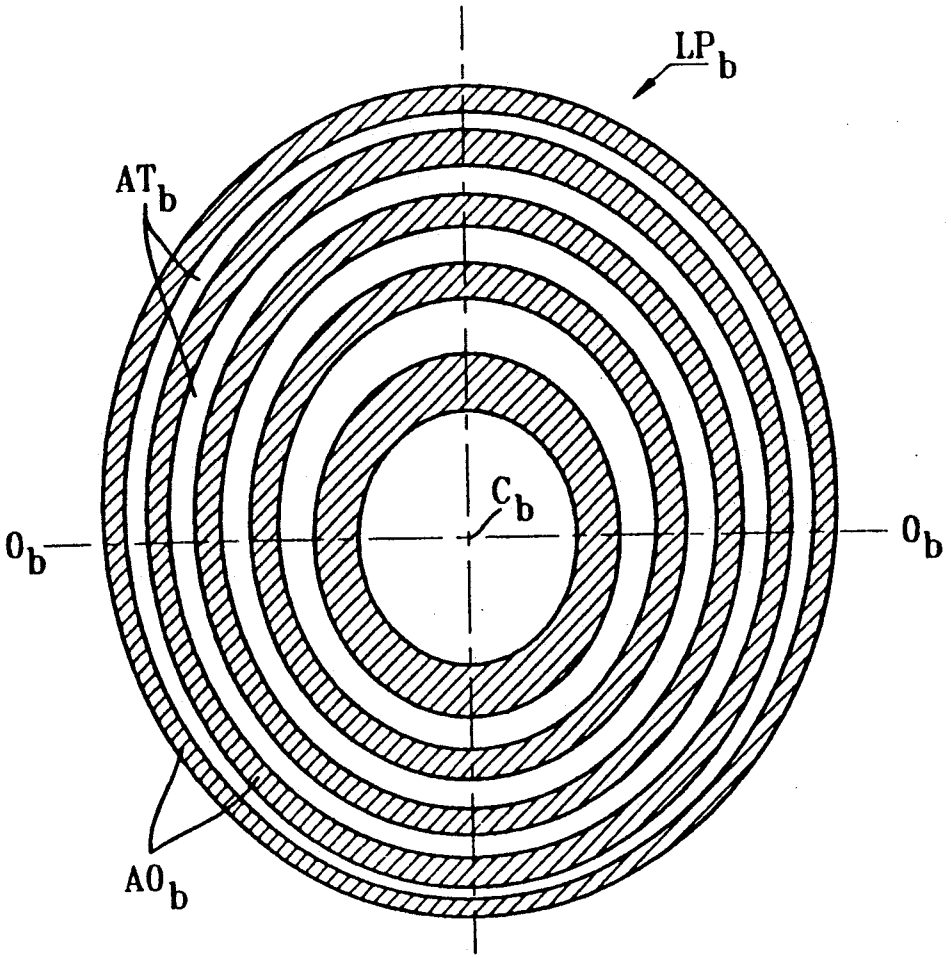
FIG. 4 (PRIOR ART)
FIGS. 3 and 4 are axial cross-section and front views of a flat FRESNEL lens with an elliptical diffraction grating.
Figure 3:
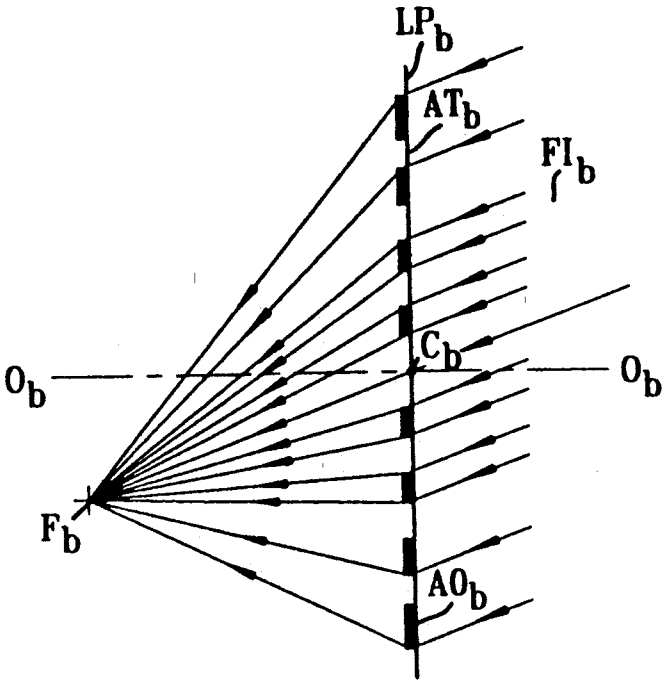
FIG. 3 (PRIOR ART)

When a collimated incident beam $FI_b$ (FIG. 3) is transmitted in a direction of incidence which is not perpendicular to the lens, and which defines an angle of incidence i with ,regard to the axis $O_b$—$O_b$ of the lens, the principle of focussing of the diffracted beam resulting from the diffraction of the beam $FI_b$ by a flat lens with rings $LP_b$ is still applicable. The lens $LP_b$ and the corresponding diffraction are shown in FIGS. 3 and 4.

By comparison with the focus $F_a$, the focus $F_b$ of the lens $LP_b$ is offset with regard to the principal axis $O_b$—$O_b$ of the lens, is nearer the centre of the lens, and is situated on the incident ray passing through the centre $C_b$ of the lens $LP_b$. The opaque rings $AO_b$ and transparent rings $AT_b$ of the lens $LP_b$ are no longer circular and concentric, but are elliptical rings that are displaced off-centre with regard to one another and with regard to the principal axis of the lens. The major axes of the rings are colinear with one another and perpendicular to the principal axis of the lens and situated in the focal plane $F_b$—$O_b$—$O_b$.

Such lenses $LP_a$ and $LP_b$ can be used for light beams having a predetermined incidence with regard to the plane of the lens. When the incident beam $FI_a$, FIis a microwave, such as a beam transmitted by a satellite at a frequency of several gigahertz, the opaque rings $AO_a$, $AO_b$ are in a conductive, i.e. metallic, material.

German patent application No. 3,801,301 advocates a plate antenna with a metallic planar reflector in front of which is disposed a planar set of circular and concentric metallic rings, like the opaque rings $AO_a$ of the FRESNEL lens $LP_a$, intended for receiving microwaves, especially millimeter waves. An incident microwave beam directed perpendicularly to the antenna is then diffracted and reflected in order to be focussed on a single focus situated perpendicular to the centre of the rings and facing the latter, i.e., situated on the right of the lens $LP_a$ in FIG. 1. The metallic rings can rest on a homogeneous material affixed to the reflector, in order for the distance between the reflector and the circular rings to be equal to approximately one quarter-wavelength.

Also to remedy the drawbacks of paraboloid-type reflectors, notably as regards costs and aesthetics, German patent application No. 3,536,348 discloses a planar antenna based on the second FRESNEL lens $LP_b$This antenna thus has a metallic planar reflector and a planar set of elliptical metallic rings.

In terms of received power, when a microwave receiving means is placed at the single focus of the plate antenna, the latter has an efficiency equal to approximately half that of a receiving antenna having the same area.

As previously stated, the invention applies, in the three-dimensional space, the principle of diffraction of FRESNEL lenses, and combines this principle with the reflection and symmetry characteristics of an antenna having axial symmetry, e.g. of the parabolic reflector, which will be referred to hereinafter.

The description hereinunder considers receiving antennae fitted with one or more reception heads, though the combinations of reflector and diffraction grating(s) embodying the invention can also serve as transmitting antennae fitted with one or more transmission heads.

Figure 5:
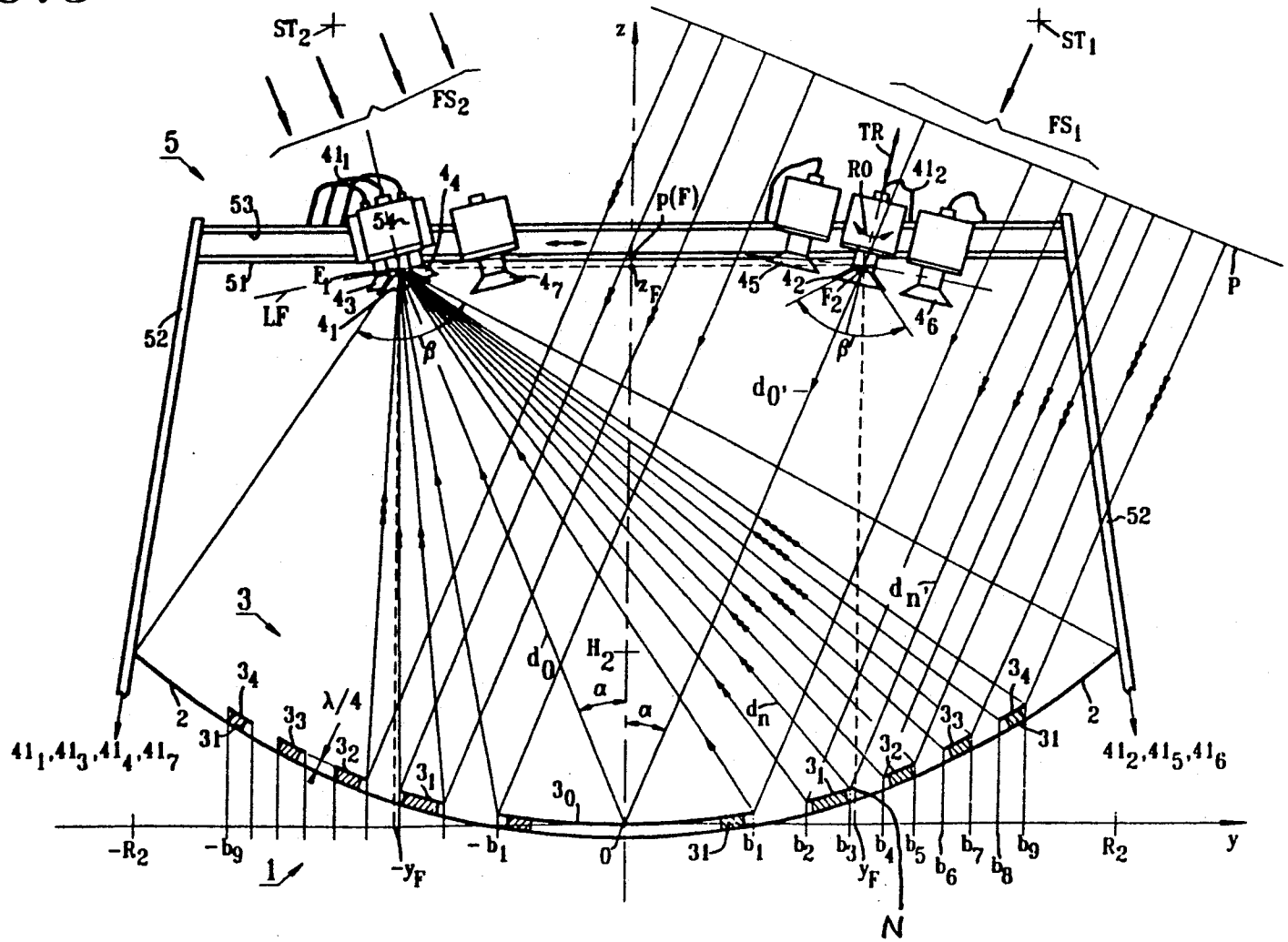
FIG. 5 is a schematic focal cross-section of a parabolic antenna having a diffraction grating and plural microwave heads according to a first embodiment of the invention.
Figure 6:
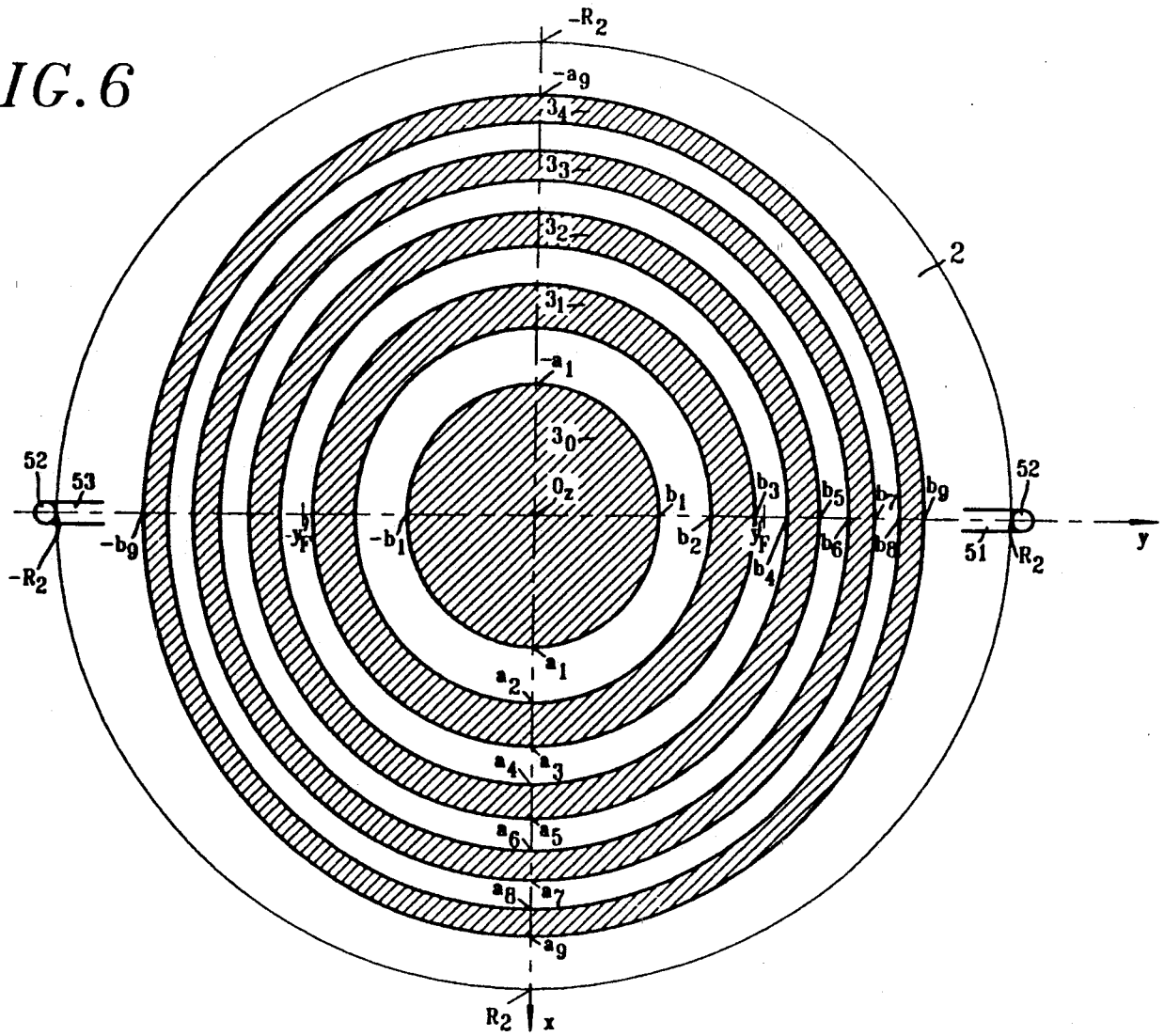
FIG. 6 is a top view of the antenna in FIG. 5, microwave heads being omitted.

As illustrated in FIGS. 5 and 6, an antenna 1 according to a first embodiment of the present invention essentially comprises a reflector 2 and an annular diffraction grating 3 both offering parallel concave reflecting surfaces, e.g. paraboloid surfaces.

To establish matters, dimensions of an antenna are indicated hereinafter by way of non-restricting examples. In particular, the dimensions of the diffraction grating 3 are indicated in relation to coordinates in an orthogonal three-axis reference system Ox, Oy, Oz. O is the centre of the grating, very close to that of the reflector, and more specifically the centre of a paraboloidal concave surface from which the grating is taken, and Oz designates the axis of symmetry of said surface and, in this instance, of the grating and of the reflector.

The reflector 2 is conventional and is comprised of a paraboloidal cap which is of revolution in this case and which is manufactured e.g. in expanded metal such as aluminium. The reflector has a thickness of 1.2 mm, a radius $R_2$ of 437 mm and a height $H_2$ of 163.5 mm. The reflector is supported by a conventional bearing structure (not shown), such as a mast and/or armouring network, and is secured e.g. to the roof of an individual house.

According to the embodiment illustrated in FIGS. 5 and 6, the diffraction grating 3 is comprised of a paraboloidal cap $3_0$, and plural paraboloidal rings $3_1$ to $3_4$, in this case four in number. However, according to another embodiment, the diffraction grating is solely comprised of annular members instead and in the place of the annular gaps between the members $3_0$ to $3_4$ of the illustrated grating 3, in a similar manner to the distribution of the opaque rings $AO_a$, $AO_b$ in the lenses $LP_a$, $LP_b$.

For instance, the grating 3 is obtained from a second reflector which is identical to the reflector 2 and in which the cap and the rings are cut out according to the dimensions indicated hereinafter. The grating 3 is affixed parallel to and upon the concave reflecting surface of the reflector 2 by means of dielectric wedges 31 positioned between and bonded to the reflector 2 and the grating 3. The wedges 31 are in electrically insulated and light material, e.g. in polystyrene. The thickness of the wedges is substantially less than a quarter of the wavelength λ, typically equal to 25/4−1.2≃5 mm, in order for the distance between the concave surfaces of the reflector 1 and the grating 3 to be substantially equal to λ/4.

The wavelength λ of the order of 2.5 cm corresponds to the average wavelength of the microwave beams to be picked up by the antenna and transmitted by geostationary satellites. For instance, the antenna 1 is initially intended to pick up two electromagnetic telecommunication beams $FS_1$ and $FS_2$ from a first satellite $ST_1$, such as the TDF 1 (or OLYMPUS or TV SAT 2) satellite situated at 19° longitude west, and from a second satellite $ST_2$, such as the ASTRA 1 satellite situated at 19° longitude east. These two satellites are seen from Paris, where antenna 1 is situated for instance, at an angle of $2\alpha=42°$, and respectively emit in frequency bands 11.7 to 12.5 GHz and 10.95 to 11.7 GHz, so that the average Wavelength corresponds substantially to 12 GHz.

The paraboloid from which the diffraction grating 3 is cut out has as equation:

$$x^2+y^2=2pz$$

where $p=R2^2/(2H2)=58.4$ cm is the parameter of the paraboloid, i.e., of the parabola $y^2=2pz$ in the plane yOz shown in FIG. 5, and equal to the focal length OF.

Again in reference to FIG. 3, it has been shown that a beam $FI_b$ having an angle of incidence i with regard to the flat lens $LP_b$ was focussed on a focus $F_b$ offset with regard to the axis $O_b$—$O_b$ of the lens. Due to the paraboloid symmetry of the antenna 1, of FIG. 5, there are two foci $F_1$ and $F_2$ which are symmetrical with regard to axis Oz and where two telecommunication beams $FS_1$ and $FS_2$ emitted by two satellites can be focussed, insofar as the axis Oz of the antenna 1 is substantially colinear with the bisecting line of the sighting angle 2α of the two satellites. In this manner, unlike the prior art, the antenna 1 is not pointed towards one of the satellites whose emissions are to be picked up, and can simultaneously receive beams emitted by at least two satellites, even though the reflector is stationary on earth, e.g. on the roof of a house. Under these conditions, two symmetrical foci $F_1$ and $F_2$ are sought on the coplanar straight half-lines $OF_1$ and $OF_2$ directed towards the satellites $ST_2$ and $ST_1$ respectively.

In fact, an incident ray coming from the satellite $ST_1$ and belonging to the beam $FS_1$ will pass through the focus $F_2$ and be reflected by the centre 0 of the cap $3_0$ into a reflected ray passing through the focus $F_1$, as shown in FIG. 5, and inversely for an incident ray of the beam $FS_2$ going through the focus $F_1$ and reflected into a ray coming from the centre 0 and passing through focus $F_2$. It should be noted that by virtue of the reciprocity between transparent rings and opaque rings in a FRESNEL lens, a series of transparent rings can be replaced by a series of reflecting rings, as previously indicated. In particular, the central paraboloidal cap $3_0$ can be preferred to a "transparent" central hole in the diffraction grating so as to substantially increase the efficiency of the antenna.

Furthermore, the position as regards height $z_F$ of foci $F_1$ and $F_2$ above the reflector must be optimized for the cones of angular aperture of microwave reception heads $4_1$ and $4_2$ placed in these foci to contain the entire reflector. As is known, these microwave heads are in the form of a box containing a given gain source feeding an amplifier followed by a frequency converter which converts the frequency-modulated signal in the 12-GHz band (centimeter waves) into a first intermediate frequency in the region of 1 to 2 GHz. These heads are connected by transmission lines, such as conventional flexible waveguides (coaxial cables), and feeder cables $41_1$ and $41_2$ to a terminal processing the signals received. In the terminal, a microwave signal switch again frequency-transposes into base band and selects the received signals before applying them e.g. to a television signal receiver. The heads $4_1$ and $4_2$ are attached to a support, such as a gantry 5, which is interdependent with the reflector bearing structure (not shown), and which will be subsequently described for several embodiments.

The two previous conditions for the position of foci $F_1$ and $F_2$ are translated by the relations:

$$tg\alpha=y_F/z_F$$

$$tg\beta=2R_2(Z_F-H_2)/[(z_F-H_2)^2-(R^2-y_F^2)]$$

where $(-y_F, z_F)$ and $(y_F, z_F)$ are the coordinates of the foci $F_1$ and $F_2$ in the focal plane yOz. According to the dimensions of the previous antenna, when $\alpha=21°$ and $\beta=58°$, this gives $$y_F=21.8 \text{ cm and } z_F=56.8 \text{ cm} < p.$$

Considering one of the two symmetrical beams $FS_1$ and $FS_2$, such as the beam $FS_1$ of which a few rays have been drawn in FIG. 5 to avoid overloading the latter, these rays coming from a given wave "plane" P are focussed by reflection onto the focus $F_1$ if the conditions of diffraction on the edges of the members of grating 3 are satisfied. For instance, with regard to the cap and ring edges of the grating half situated to the right of the axis of symmetry Oz in FIG. 5 having for coordinates $b_1$ to $b_9$, where $b_n$ with n an odd integer designates an outer cap or ring edge and, $b_n$ with n even designates an inner ring edge, the path delays are as follows:

$$d_O'+d_O=d_1'+d_1+\lambda/2=d_n'+d_n+n\lambda/2.$$

The distances $d_n'$ and $d_n$ designate the length of the ray coming from plane P to the edge of coordinate $y_n=b_n$ and the ray length from this edge to the focus $F_1$, the distances $d_O'$ and $d_O$ concerning the reflection at the centre 0 of the cap $3_0$.

Relations similar to the previous ones are also satisfied for rays reflected by the reflector 2 passing in gaps between the elements $3_0$ to $3_4$ of the grating, since the distance between the grating and the reflector is equal to (λ/2)/2λ/4.

Presupposing a wave plane P passing through focus $F_2$, each of the following relations $$d_O'+d_O=d_n'+d_n+n\,\lambda/2$$

is reduced, by simple geometrical relations, to:

$$2\,(y_F+z_F)^{\frac{1}{2}}=d_n'\,(y_n, z_n)+d_n\,(y_n, z_n)+n\,\lambda/2$$

where $y_n=b_n$ and $z_n\ b_n^2/(2p)$, and $d_n'$ and $d_n$ are indicated hereinafter for $x_n=0$.

Calculation of these relations give the y-coordinates of the edges of the members in diffraction grating 3 :

$b_1=12.01$ cm
$b_2=17.08$ cm
$b_3=21.03$ cm
$b_4=24.41$ cm
$b_5=27.44$ cm
$b_6=30.22$ cm
$b_7=32.81$ cm
$b_9=37.60$ cm

The widths $b_1$, $b_3 - b_2$ to $b_9 - b_8$ of the metallic members of the grating 3 can be seen, as can the widths of the gaps between the members along axis Oy, to decrease from the centre O towards the periphery of the reflector.

In order to completely determine the contours of the edges of members $3_0$ to $3_4$ of the diffraction grating, a search is made, in respect of each edge of y-coordinate $b_n$, of all the rays coming from a wave plane perpendicular to the beam $FS_1$ such as a plane $P(F_2)$ passing through the focus $F_2$, which satisfy the relation:

$$d_O+d_O'=d_n+d_n'+n(\lambda/2)$$

and more precisely the coordinates $x_n$, $y_n$ and $z_n$ of the points N satisfying this relation and which are on the paraboloid of the grating 3 having for equation:

$$x_n^2+y_n^2=2pz_n$$

The plane $P(F_2)$ passing through the focus $F_2$ (O, $y_F$, $z_F$) has as equation in the coordinate system (Ox, Oy, Oz):

$y \sin\alpha+z \cos\alpha\ (y_F \sin\alpha+z_F \cos\alpha)=O$, whence : $y\ (y_F/z_F)+z-(y_F^2/z_F+z_F)=O$ The distance $d_n'$ from the point N ($x_n$, $y_n$, $z_n$) to the plane $P(F_2)$ is:

$$d_n'=[y_n\ (y_F/z_F)+z_n+(y_F^2/z_F+z_F)][/\ (y_F/z_F)^2+1]^{\frac{1}{2}}$$

and the distance $d_n$ from the point N to the focus $F_1$ (O, $-y_F$, $z_F$) is:

$$d_n=[x_n^2+(y_n+y_F)^2+(z_n-z_F)^2]^{\frac{1}{2}}$$

Given that $b_n^2=2p\ z_n$, from the previous equation are deduced the coordinates $x_n$ and $y_n$ of the points N which are situated on an ellipse which is perpendicular to Oz and centered on the latter and of which the minor axis $2b_n$ is in the focal plane $F_1OF_2$ and of which the major axis $2a_n$ is perpendicular to the focal plane. The values of $a_n$ in relation to the axis Ox (FIG. 6) for the edges of the grating members according to the example are:

$a_1=12.8$ cm
$a_2=18.2$ cm
$a_3=22.44$ cm
$a_4=26.09$ cm
$a_5=29.39$ cm
$a_6=32.46$ cm
$a_7=35.34$ cm
$a_8=38.10$ cm
$a_9=40.77$ cm

Like the widths of the metallic members of the grating according to axis Oy, the widths of the latter according to axis Ox and the widths of the annular gaps between the members according to axis Ox decrease from the centre O towards the periphery of the reflector. The widths of the members and gaps according to the major axes $2a_1$ to $2a_9$ are substantially greater than the widths of the members and gaps according to the minor axes $2b_1$ to $2b_9$. In other words, the eccentricities of the elliptical edges of the members $3_0$ to $3_4$ of the diffraction grating increase substantially as one moves towards the periphery.

The eccentricities, according to the example under consideration, vary by four hundredths which, in practice, enables good results to be obtained in terms of antenna efficiency when the elliptical contours of each of the rings $3_1$ to $3_4$ are parallel, and therefore when the width of each ring is constant and equal to the corresponding difference:

$$b_{n+1}-b_n, \text{ whence } a_{n+1}=a_n+b_{n+1}-b_n$$

This facilitates production of the rings which can be approximated to conical surfaces since the parameter p of the paraboloid of the reflector is big in this case.

The diffraction grating as described above and illustrated in FIGS. 5 and 6 satisfies, by first approximation, the relations $$d_O'+d_O=d_n'+d_n+n\lambda/2$$

since in relation to the edges situated on the other side of axis Oz in FIG. 5, the path delays are as follows:

$$d_O'+d_O=d_n'+d_n-n\lambda/2$$

which could impose a substantial dissymmetry of the grating members in the focal plane yOz, the latter having been suppressed to simplify construction of the grating.

More generally, the invention thus deals with an antenna whose diffraction grating members satisfy the following path difference relation:

$$(d_O'+d_O)=(d_n'+d_n)\pm n\lambda/m,$$

where m is preferably an integer, though it may be any number whatsoever.

When m=2, the antenna is of the type as defined above in reference to FIGS. 5 and 6.

According to another example shown in FIGS. 7 and 8, the antenna comprises m−1=3 diffraction gratings $R_1$, $R_2$ and $R_{m-1}=R_3$ which are disposed parallel to the reflector 2, in this case substantially paraboloidal, and which are distant two-by-two from one another by $\lambda/(2.m)=\lambda/8$. The gratings $R_1$ to $R_{m-1}=R_3$ have main outer diffraction edges $B_1$, $B_2$, $B_3$, . . . $B_n$ of circular rings, or elliptical rings, which are substantially stacked perpendicularly to the reflector and more particularly in the direction of a focus $F_1$, $F_2$ in the opposite direction in relation to the central axis Oz, so that the path delays $d_{n-1}'+d_{n-1}$ and $d_n'+d_n$ from an edge $B_{n-1}$ to the next edge $B_n$ differ substantially by one wavelength λ.

For the purposes of simplifying the diagrams, it is presupposed in FIG. 7 that foci $F_1$ and $F_2$ are merged into a focus FO on the focal line LF and axis Oz, towards which converges an electromagnetic beam diffracted by the gratings. From a main outer edge $B_{n-1}$, the gratings $R_1$ to $R_{m-1}=R_3$, according to their ascending rank 1 to m−1 from the reflector 2, comprise a group of stacked rings of which the inner edges move away from the central axis Oz in "stairway steps" and which correspond to path delays of $((n-1)m+1)\lambda/m$, $((n-1)m+2)\lambda/m$, . . .

$((n-1)m+m-1)\lambda/m=(nm-1)\lambda/m$ with regard to rays diffracted towards the focus FO. In other words, the widths of the rings of gratings $R_1$ to $R_{m-1}=R_3$ which are stacked and grouped at the level of a "common" outer edge $B_n$ decreasing arithmetically from one ring to the next by a common difference substantially equal to the width of the ring of the highest grating $R_{m-1}=R_3$. Thus, e.g. for m=4 and at the level of a same outer edge $B_n$, the ring of the second grating $R_2$ has, on the one hand, a width 2w substantially equal to two-thirds of the width 3w of the ring of the first grating $R_1$ immediately above the reflector 2 and covers substantially two-thirds of this ring of the grating $R_1$ from the edge $B_n$, and on the other hand, has a width substantially equal to one-third of the width w of the ring of the third grating $R_3$ and is covered substantially by a third of this ring of the grating $R_3$ from the edge $B_n$; inner edges of the above-mentioned rings of the gratings $R_1$ to $R_3$ are separated from the main edge $B_{n-1}$ by annular gaps having widths substantially of w, 2w and 3w.

The stacking of the gratings $R_1$ to $R_3$ can be achieved by means of a set of annular dielectric wedges $D_1$, $D_2$ and $D_3$ of thickness substantially less than or equal to $\lambda/(2m)=\lambda/8$ and having widths respectively equal to or less than the grating rings, as shown in FIG. 7.

According to another embodiment, a homogeneous continuous layer made in a dielectric material can cover the reflector 2 according to the embodiments shown in FIGS. 5 and 7 in order to support the grating 3, respectively grating $R_1$; likewise, in the antenna of the type in FIG. 7, the sets of dielectric rings can be replaced by continuous dielectric layers stacked with the gratings.

Various production processes of an antenna embodying the invention comprising 1 or m−1 diffraction gratings are briefly discussed hereinunder.

When the antenna comprises layers or dielectric wedges between the surfaces on which the gratings and the reflector extend, the gratings can be manufactured in the form of annular metallic layers printed or deposited by all known method on stacked and bonded dielectric layers, or even printed or deposited on a single dielectric layer machined or molded in steps; or each ring is made in the form of concentric metallic wires separated from one another by a short distance with regard to the wavelength and interdependent with or integrated into a preferably transparent dielectric material; or the gratings are made according to the thin-layer technique also referred to as the multilayer technique. The dielectric material can be partially or totally opaque such as polystyrene, or transparent such as glass. The stair raisers, substantially $\lambda/(2m)$ thick, can be coated with a metallic layer, or with an anti-reflection layer which absorbs electromagnetic waves in order to avoid all unwanted spurious reflection.

According to other embodiments, the continuous profile of the diffraction gratings and of the stairway step-type reflector according to the cross-section shown in FIG. 7 is obtained by stamping of a homogeneous or perforated metallic plate, or in expanded metal, constituting both reflector and diffraction gratings by itself. Irrespective of the production model, the antenna can result from the assembly of two, three, four or more substantially identical curved sectors, subsequent to a regular radial division of the top view of the antenna shown in FIG. 6 or 8, or of substantially curved "petals" having a substantially rectangular contours and assembled along sides parallel to axes Ox and Oy.

Though a paraboloid of revolution reflector antenna, i.e., having circular cross sections perpendicular to axis Oz, has been described above as an example, the invention also applies to antennae having an elliptical paraboloidal reflector, and more generally to any antenna which comprises a reflector with a concave reflecting surface having an axis of symmetry in a focal plane.

As a variant, the reflector can be constituted by a portion of such a reflecting surface so as to constitute an antenna of the off-axis source type, also known as offset source. In this case, the diffraction grating or set of diffraction gratings is cut out of a second portion identical to the reflecting surface portion of the reflector, according to the contour of the off-axis reflector, and certain members of the grating or of each grating, especially peripheral members, can only be annular sectors.

As previously stated, the microwave heads $4_1$ and $4_2$ are supported e.g. by a thin gantry 5 in light material, placed in front of the reflector 2. The gantry essentially comprises, as shown in FIG. 5, a girder 51 disposed perpendicularly to axis Oz and situated in the focal plane F1 - O - F2, and two posts 52 substantially parallel to axis Oz and connecting the ends of the beam to peripheral ends of the bearing structure (not shown) of the reflector. The girder and posts can be in light alloy tubes in which cables $41_1$ and $41_2$ are run in the direction of the reception terminal.

The same antenna 1 embodying the invention, i.e., the same combination of reflector 2 and diffraction grating 3 or the set of diffraction gratings $R_1$ to $R_{m-1}$ naturally accepts positions of the reception heads in the region of foci $F_1$ and $F_2$ for picking up beams from satellites having neighbouring orbital positions and thus corresponding to substantially equal sighting angles $\alpha$.

Experience has also shown that the same antenna 1 is usable for picking up beams coming from satellites associated with sighting angles that differ by several degrees from angle $\alpha$, i.e., with directions of radiation that are very different from directions $OF_1$ and $OF_2$. In fact, e.g. a beam coming from the right in FIG. 5, like beam $FS_1$, but associated with an even smaller sighting angle with respect to axis Oy, will be picked up with an acceptable efficiency when a reception head is placed between focus $F_1$ and axis Oz. Measurements have shown that the reception heads must be substantially centred on a curved focal line LF symmetrical with regard to axis Oz, passing through foci $F_1$ and $F_2$, and having a radius of curvature greater than the distance between the reflector centre and a focus $F_1$, $F_2$; however, in practice, the focal line LF can be approximately defined by an arc of circle having as centre the centre of the reflector or the centre 0 of the diffraction grating(s) and a radius of the order of $OF_1$ to $(2.OF_1)$. Under these conditions, the girder 51 is preferably substantially curved according to the focal line LF.

On the one hand, the girder 51 thus supports plural first reception heads, such as heads $4_1$, $4_3$ and $4_4$, which are secured in the region of one $F_1$ of the foci for respectively picking up satellite beams coming from the right of axis Oz. For instance, beside head $4_1$ assigned to the TDF 1 satellite are disposed two other first heads $4_3$ and $4_4$ assigned to the OLYMPUS and TV SAT 2 satellites situated at 19° longitude west.

On the other hand, the girder $5_1$ also supports plural second reception heads, such as the heads $4_5$, $4_6$ and $4_7$ which are fixed near the foci $F_1$ and $F_2$ in relation to axis Oz of the antenna for respectively picking up beams coming from satellites having orbital directions, as seen from the antenna, differing distinctly from $OF_2$ and $OF_1$. For instance, close to focus $F_2$ where the head $4_2$ attributed to the ASTRA 1 satellite situated at 19° longitude east is located, are positioned a second head 1 45 assigned to the reception of the beam from the EUTELSAT1 F1 satellite situated at 16° longitude east, and another second head $4_6$ assigned to the reception of the beam from the KOPERNIKUS 1 satellite situated at 23,5° longitude east. According to another example, another second reception head $4_7$ is positioned near focus $F_1$ for picking up the beam emitted by the TELECOM 1A satellite having an orbital positions of 8° longitude west.

These various reception heads $4_1$ to $4_7$ are connected by cables $41_1$ to $41_7$ running through the gantry 5 to the microwave signal switch of the terminal processing the received signals associated with the antenna 1. These heads can be of various known types and conform with the linear, circular or elliptical polarization or the respective microwave beams. Of course, each of the heads is matched to the carrier frequency of the signals emitted by the respective satellite. Insofar as the carrier frequency band has a width of several gigahertz, the dimensions of the diffraction grating 3 or diffraction gratings $R_1$ to $R_{n-1}$ and the distances $\lambda/(2.m)$ between gratings and reflector are not critical. These dimensions are thus calculated for a substantially average frequency in the carrier frequency band of the telecommunication beams, typically equal to 12 GHz for frequencies included substantially between 11 and 13 GHz.

According to this first head support embodiment, the girder 51 of the antenna comprises mechanical means for manually adjusting the positions of the heads $4_1$ to $4_7$ in order to suitably orientate the angular aperture $\beta$ of each of the heads as a function of the dimensions of the reflector 2 and thus pick up the maximum of radiation. The adjusting means consist e.g. in a girder 51 comprising one or more longitudinal sliding rails 53 parallel to the plane yOz or to the focal line LF, in which can be slid sliders 54 interdependent with the head mountings. On the corresponding slider, each head is mounted on the one hand rotatably about an axis substantially perpendicular to the axis of symmetry Oz, preferably parallel to the axis Ox, and, on the other hand, translatably along its longitudinal axis and therefore in a direction substantially converging towards the centre of the reflector, as indicated by double arrows RO and TR for head $4_2$ in FIG. 5. With these various displacement means is associated known locking means so as to stabilize the position of the head along the girder 51 and the orientation thereof in a plane substantially parallel to the focal plane yOz. Under these conditions, each head can be efficiently positioned near one of the foci $F_1$ and $F_2$ or more generally in an optimal emission / reception position substantially along the focal line LF.

In another embodiment, the head position adjusting means can be partially or totally motorized, and preferably remote-controlled via cables attached to the gantry 5. The motorization of the adjusting means is particularly appreciable when the antenna is fixed to the roof of a house, where it is naturally difficult to access. In this case, the antenna user adjusts the positions of the heads from the ground, and can reduce the number of heads supported by the girder, by means of frequency matchings and selections.

Figure 9:
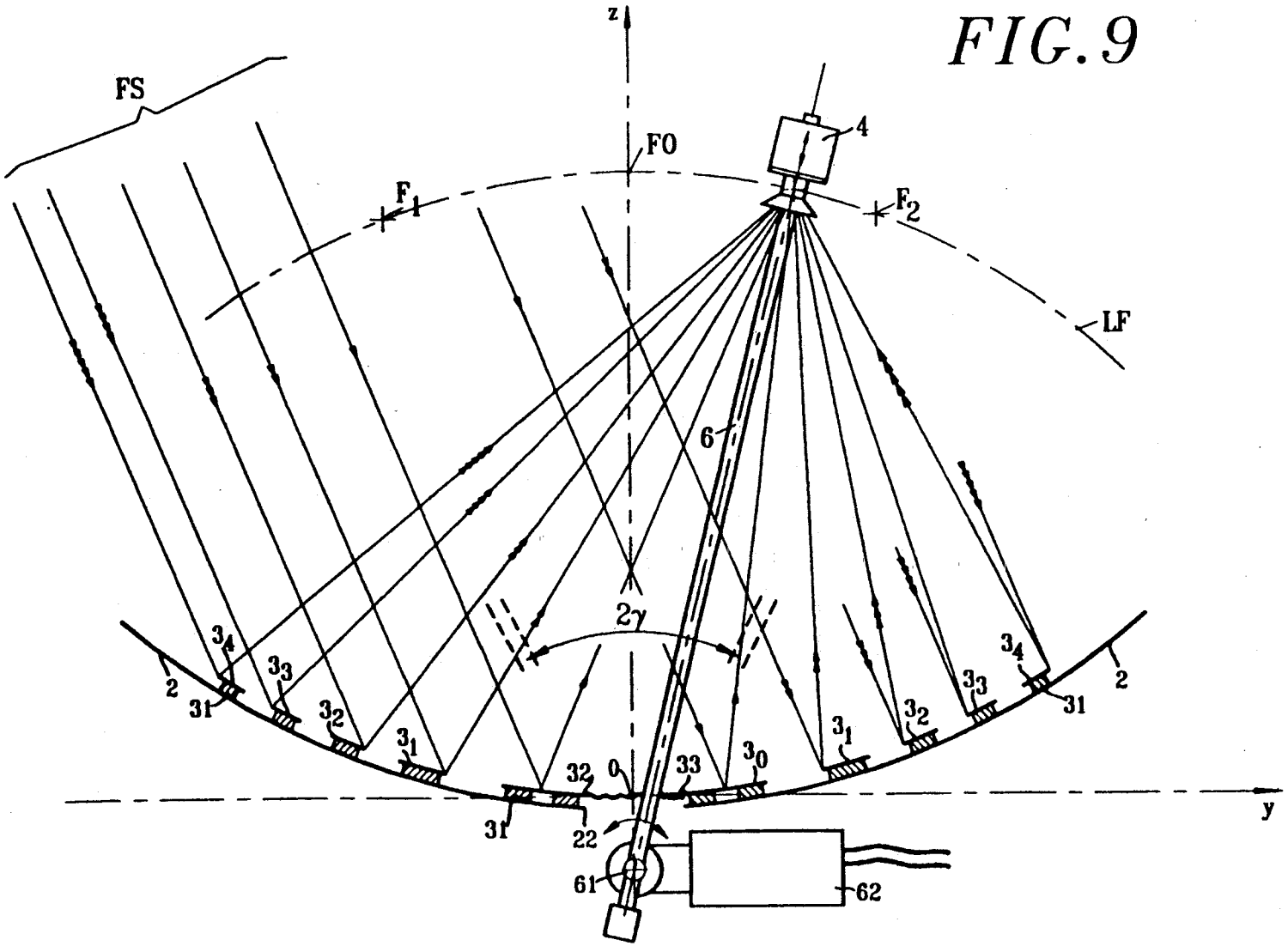
FIG. 9 is a schematic focal cross-section view of an antenna having a diffraction grating and a single mobile microwave head according to the invention.

According to a second and more economical embodiment, though the reflector 2 is always maintained stationary according to the orientation specified above, the antenna only comprises a single microwave head 4, as shown in FIG. 9.

The head 4 is fixed to the upper end of a supporting arm 6 which runs through a double opening or hole 32-22 made in the centres of the cap $3_0$ of diffraction grating 3 and reflector 2 for the embodiment illustrated in FIG. 9 in accordance with FIG. 5, or a single opening or hole 22 in the centre of the reflector for an embodiment in accordance with FIG. 7. The lower end of the arm 6 beneath the reflector is pivotably mounted about an axis 61 which is substantially parallel to axis Ox and connected by mechanical transmission means, e.g. of the gearing type, to a small electrical motor 62 remote-controllable from the ground. The motor 62 and the axis 61 are fixed to the bearing structure of the reflector.

The width of the opening or hole 33-22, or 22, is such that the arm can sweep a plane parallel and close to the focal plane yOz and the head 4 can then track substantially along the focal line LF on either side of the axis of symmetry Oz up to an angle $\gamma$ greater than angle $\alpha$, i.e., of the order of 40°. The length of the arm 6 is such that the radius between the head 4 and the axis of revolution 61 is greater than the distance $OF_1=OF_2$. In this respect, the head 4 is preferably mounted longitudinally slidable at the upper end of the arm in order to track more precisely along the predetermined focal line LF.

Under these conditions, when the motor 62 is activated, e.g. step-by-step or in an automatic manner for predetermined head positions, the user controls the rotation of the arm from the ground in order to position the head at one of the required positions for picking up the beam coming from one of the satellites. Simultaneously, the microwave switch in the reception terminal is locked to the associated carrier frequency (after frequency conversion in the head).

In another embodiment, the lower end of the arm 6 can be mobile inside a cone with circular or elliptical straight cross section, notably as a function of the type of reflector used. In this case, the displacement means 61-62 of the arm are equivalent to a driven universal point articulation.

According to this second embodiment, the head 4 is of the multipolarization type such as the helix source type. It is connected to the reception terminal by a conventional low-loss guidewave, or by an optical fiber housed in the arm 6.

Preferably, the double opening or hole 33-22 or the single opening or hole 22 is covered with a dielectric layer, or is closed by a flexible dielectric membrane 33 traversed by the arm 6 in order to avoid any radiation reflected at the centre of the antenna susceptible of detrimentally perturbing the received beam to be diffracted.

What is claimed is:

1. An antenna for receiving plural telecommunication beams, comprising:

(a) a fixed reflector (2);

(b) a diffraction grating (3) including a plurality of generally annular concentrically arranged diffraction members ($3_1-3_4$), at least a portion of said grating being adjacent and generally parallel with said reflector, said grating and said reflector having concave reflecting surfaces at least portions of which are substantially symmetrical about an axis of symmetry ($O_2$), said grating defining first ($F_1$) and second ($F_2$) foci which are symmetrical relative to said axis of symmetry, said diffraction grating being operable to reflect and converge on said first and second foci first ($FS_1$) and second ($FS_2$) ones of said telecommunication beams that are directed toward said grating in directions parallel with the straight lines ($d_o$, $d_o'$) that extend from the center (O) of said symmetrical surface through said first and second foci, respectively; and (c) at least one microwave head ($4_1$, $4_2$) arranged generally along a generally curved focal line (LF) that:

(1) is centered relative to said axis of symmetry;

(2) has a radius of curvature that is greater than the distance ($d_o$, $d_o'$)between said symmetrical surface center and either of said first and second foci; and (3) passes through said first and second foci.

2. The antenna claimed in claim 1, wherein the widths of said grating members decrease radially from said axis of symmetry, and the widths of gaps between said grating members decrease radially from said axis of symmetry.

3. The antenna claimed in claim 1, wherein at least one part of said grating members have substantially elliptical contours which have minor axes located in a focal plane containing said first and second foci and said axis of symmetry.

4. The antenna claimed in claim 1, wherein at least one part of said grating members have circular and concentric contours.

5. The antenna claimed in claim 1, wherein said diffraction grating is connected to said concave reflecting surface of said reflector via dielectrical material.

6. The antenna claimed in claim 1, wherein said diffraction grating and said reflector constitute an assembly that is supported by a dielectric material in the shape of annular stairway steps.

7. The antenna claimed in claim 1, wherein said diffraction grating and said reflector constitute thin layers in a dielectric material.

8. The antenna claimed in claim 1, wherein said diffraction grating and said reflector are constituted by a stamped metallic plate.

9. The antenna claimed in claim 1, wherein said diffraction grating comprises a central cap-shaped member substantially symmetrical with regard to said axis of symmetry.

10. The antenna claimed in claim 1, wherein said reflector and said grating are substantially distant by one quarter-wavelength corresponding substantially to a frequency in a carrier frequency band of said telecommunication beams.

11. An antenna as claimed in claim 1, comprising plural different gratings of annular diffraction members stacked parallel in front of said reflector.

12. The antenna claimed in claim 1, wherein it comprises plural microwave heads located substantially near said focal line.

13. An antenna as claimed in claim 12, comprising means for adjusting and locking positions and orientations of said heads.

14. An antenna as claimed in claim 1, comprising means for moving said head substantially along said focal line.

15. The antenna claimed in claim 14, wherein said had moving means comprise an arm extending across a central region of said antenna and having a first end supporting said head, and a second end mounted at least rotatably around an axis substantially perpendicular to a focal plane containing said first and second foci and said axis of symmetry.

16. An antenna for receiving plural telecommunication beams, comprising:

(a) a fixed reflector (2);

(b) a diffraction grating (3) including a plurality of generally annular concentrically arranged diffraction members ($3_1-3_4$), at least a portion of said grating being adjacent and generally parallel with said reflector, said grating and said reflector having concave reflecting surfaces at least portions of which are substantially symmetrical about an axis of symmetry ($O_z$), said grating defining first ($F_1$) and second ($F_2$) foci which are symmetrical relative to said axis of symmetry, said diffraction grating being operable to reflect and converge on said first and second foci first ($FS_1$) and second ($FS_2$) ones of said telecommunication beams that are directed toward said grating in directions parallel with the straight lines ($d_o$, $d_o'$) that extend from the center (O) of say symmetrical surface through said first and second foci, respectively, a plurality of said gratings being of different size and being stacked in groups in parallel relation in front of said reflector with each group containing a grating of each size, the annular members of each group having outer edges stacked substantially perpendicular to said reflector and having inner edges forming steps from said reflector; and (c) at least one microwave head ($4_1$, $4_2$) arranged generally along a generally curved focal line (LF) that:

(1) is centered relative to said axis of symmetry;

(2) has a radius of curvature that is greater than the distance ($d_o$, $d_o'$) between said symmetrical surface center and either of said first and second foci; and (3) passes through said first and second foci.

17. The antenna claimed in claim 16, wherein the widths of said annular members in each of said groups decrease arithmetically from said reflector with a common difference substantially equal to the width of the member in the group furthest away from said reflector.

18. An antenna for receiving plural telecommunication beams, comprising:

(a) a fixed reflector (2);

(b) a diffraction grating (3) including a plurality of generally annular diffraction members ($3_1$–$3_4$), at least a portion of said grating being adjacent and generally parallel with said reflector, said grating and said reflector having concave reflecting surfaces at least portions of which are substantially symmetrical about an axis of symmetry ($O_z$), said grating defining first ($F_1$) and second ($F_2$) foci which are symmetrical relative to said axis of symmetry, said diffraction grating being operable to reflect and converge on said first and second foci first ($FS_1$) and second ($FS_2$) ones of said telecommunication beams that are directed toward said grating in directions parallel with the straight lines ($d_o$, $d_o'$) that extend from the center (O) of said symmetrical surface through said first and second foci, respectively; and (c) at least one microwave head ($4_1$, $4_2$) arranged generally along a generally curved focal line (LF) that:

(1) is centered relative to said axis of symmetry;

(2) has a radius of curvature that is greater than the distance ($d_o$, $d_o'$) between said symmetrical surface center and either of said first and second foci; and (3) passes through said first and second foci;

(d) a plurality of said gratings being of different size and being stacked in parallel in front of said reflector, the distance between said reflector and the adjacent one of said gratings, and the distances between two neighboring gratings being generally equal to $\lambda/(2.m)$, where $\lambda$ denotes a wavelength corresponding substantially to a frequency in a carrier frequency band of said telecommunication beams, and $m-1$ designates a number of said diffraction gratings.

* * * * *